US006112334A

United States Patent [19]

Chiang

[11] Patent Number: 6,112,334

[45] Date of Patent: Sep. 5, 2000

[54] SWIMMING GOGGLES WITH A NOSE-FITTING BRIDGE

[76] Inventor: Herman Chiang, 2F, No. 634-9, Ching-ping Rd., Chung-Ho City, Taipei Hsien, Taiwan

[21] Appl. No.: 09/408,460

[22] Filed: Sep. 29, 1999

[51] Int. Cl.[7] ..... A61F 9/02

[52] U.S. Cl. ..... 2/428; 2/445; 2/452

[58] Field of Search ..... 2/426, 445, 452, 2/444

[56] References Cited

U.S. PATENT DOCUMENTS

| | | | |
|---|---|---|---|
| 4,348,775 | 9/1982 | Haslbeck | 2/452 |
| 5,524,300 | 6/1996 | Chiang | 2/439 |
| 5,596,771 | 1/1997 | Hsu et al. | 2/428 |
| 5,734,995 | 4/1998 | Chiang | 2/428 |
| 5,890,237 | 4/1999 | Herman | 2/440 |
| 5,894,605 | 4/1999 | Chiang | 2/428 |
| 5,894,606 | 4/1999 | Chiang | 2/440 |
| 5,896,588 | 4/1999 | Chiang | 2/428 |

*Primary Examiner*—John J. Calvert
*Assistant Examiner*—Robert H. Muromoto
*Attorney, Agent, or Firm*—Pro-Techtor International Services

[57] ABSTRACT

The invention relates to a type of swimming goggles with a nose-fitting bridge, comprising: two frames, two lenses accommodated on the two frames, a nose bridge connecting the two frames, and a headband device that is fitted to the outside edges of the two frames, characterized in that: said nose bridge has at least one face-fitting part, said face-fitting part forming recesses from the exterior surface of the nose bridge towards the frames, the bottom ends of said recesses are protruded to have proper contact with the ridge of the user's nose, so designed to enable the nose bridge of the swimming goggles to join the two frames, to have better contact with the ridge of the user's nose, to provide better comfort, and to ensure better resistance to water seepage.

11 Claims, 5 Drawing Sheets

SWIMMING GOGGLES WITH A NOSE-FITTING BRIDGE

BACKGROUND OF THE INVENTION

The subject invention relates to a type of swimming goggles, particularly one that can have better fitting and contacting effects between a nose bridge and the ridge of the user's nose, providing better comfort.

Whether swimming goggles are comfortable to wear will depend on the consideration of resistance to water seepage and fitting contact with the user's face. The construction of conventional swimming goggles is shown in FIGS. 1 and 2. The connection between the nose bridge and the frames can be either of integrated type or connecting type. The nose bridge 5 (shown in FIG. 1) of the connecting type will be able to adjust the distance between two frames, with adjustment of position made by squeezing some ribs 50 into slots 51 on the nose bridge, but after extended use the ribs 50 will become flattened and the function of adjustment will fail, which results in poor connection and discomfort on the user's head. The conventional type of nose bridge 6 (FIG. 2) in an integrated type could not be adjusted, and it fails to keep in comfortable contact with the ridge of the user's nose, so it lacks comfort and resistance to water seepage.

BRIEF DESCRIPTION OF THE INVENTION

The main objective of the subject invention is to provide a type of swimming goggles with a nose-fitting bridge, the nose bridge of said swimming goggles will be able to connect the frames, to have better fitting contact with the ridge of the user's nose, to provide better comfort in use, and ensure resistance to water seepage.

To achieve said objective, the swimming goggles with a nose-fitting bridge is characterized in that: said nose bridge has at least one face-fitting part, said face-flitting part involves the formation of recesses from the nose bridge towards the frames, and the bottom ends of the recesses are protruded to have proper contact with the ridge of the user's nose.

In the above characteristics, the face-fitting part is preferably located at the right and left sides of the nose bridge, to provide better and comfortable contact with the ridge of the user's nose.

The subject invention of swimming goggles with a nose-fitting bridge is further characterized in that, at the connection between the exterior surface of said nose bridge and the two frames of the goggles are slotted grooves, so designed to provide better fitting and contacting effects.

BRIEF DESCRIPTION OF NUMERALS

| | | | |
|---|---|---|---|
| Frame | 10, 11, 10', 11' | | |
| Lens | 12, 13, 12', 13' | | |
| Protective pad | 14, 15, 14', 15' | | |
| Connecting hole | 16, 17 | | |
| Nose bridge | 2, 2' | tenon post | 201, 201' |
| Jut | 202, 202' | mortise groove | 211' |
| catch groove | 212' | recess | 22, 23 |
| Recess | 22', 23' | slotted groove | 24 |
| Exterior surface | 21, 21' | nose ridge | 70 |

DETAILED DESCRIPTION OF PREFERRED EMBODIMENT

Figure 2:
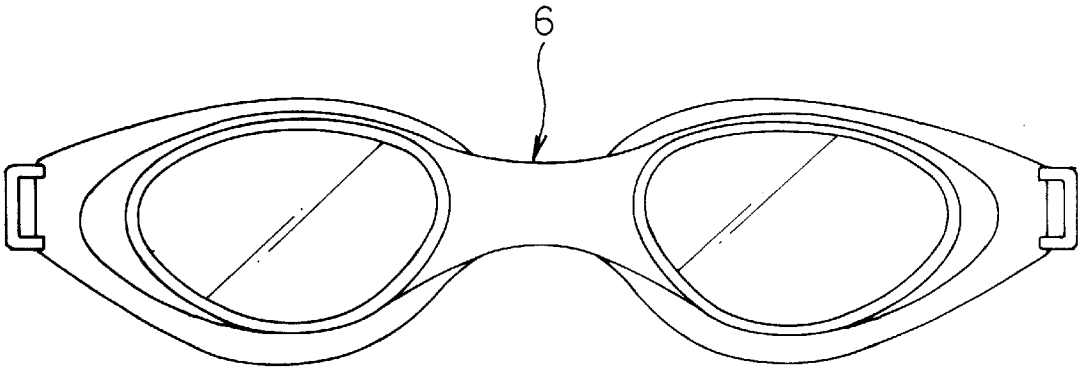
FIGS. 1 and 2 are perspective views of a prior art of swimming goggles.
Figure 1:
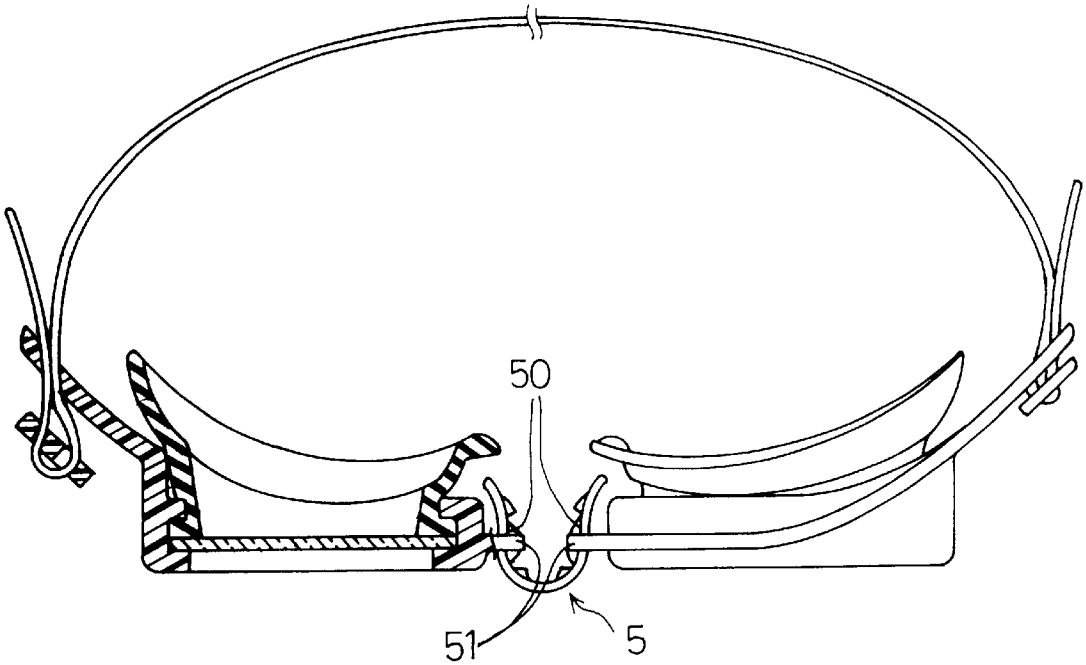
Figure 3:
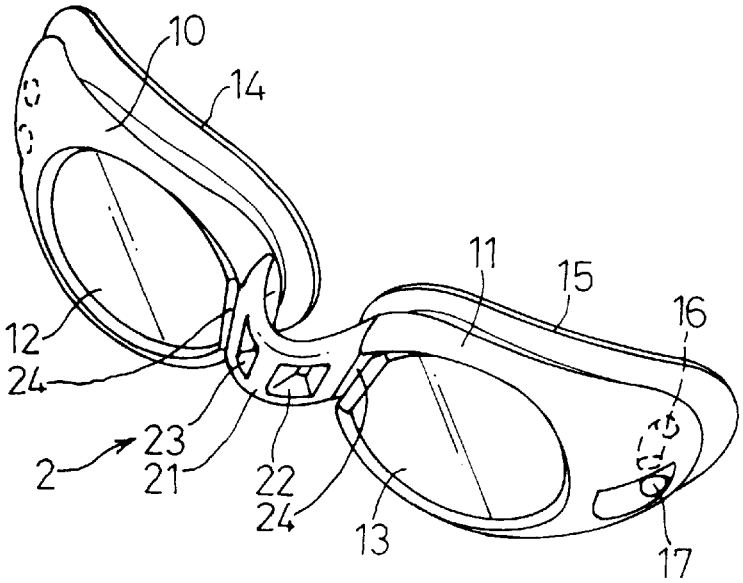
FIG. 3 is a perspective view of the subject invention of swimming goggles with a nose-fitting bridge

Please refer to FIG. 3, which is a perspective view of the subject invention of swimming goggles with a nose-fitting bridge. As shown in the drawing of this embodiment, the swimming goggles I are of an integrated type, with two frames 10 and 11, a nose bridge 2 and two protective pads 14 and 15 that are monoblock formed, each frame 10/11 accommodating a lens 12/13, on the outer end of the frame 10/11 is a connecting hole 16/17, the connecting hole 16 serving to facilitate connection with a headband device (not shown in drawing) is hidden on the exterior surface of the frame. Said nose bridge 2 is located between the two frames 10 and 11, on which is a face-fitting part, said face-fitting part involves two recesses 22 and 23 that are located on two sides of the exterior surface 21 of the nose bridge 2, the bottom ends of said recesses 22 and 23 are protruded to contact properly with the ridge of nose. Please refer to FIG. 4 simultaneously, the bottom ends of said recesses 22 and 23 are in contact with the ridge of the user's nose 70 to provide comfortable fitting effect. At the joints between the exterior surface 21 of the nose bridge 2 and the two frames 10 and 11 are slotted grooves 24, providing better contact and comfort when the goggles are worn on the user's head. By the design of the recesses 22 and 23 and the slotted grooves 24 on the nose bridge 2 of the subject invention, the monoblock formed swimming goggles comprising of a nose bridge, two frames and two protective pads will provide better contact and comfort, we well as better resistance to water seepage.

Figure 5:
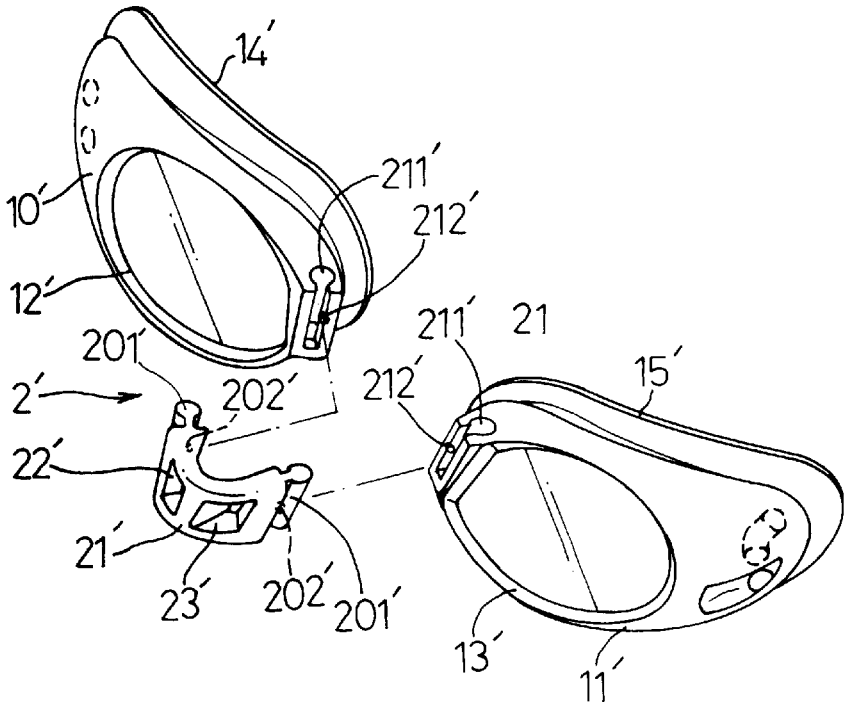
FIGS. 5 and 6 are a perspective view and an assembled view of a second embodiment of the subject invention of swimming goggles.
Figure 4:
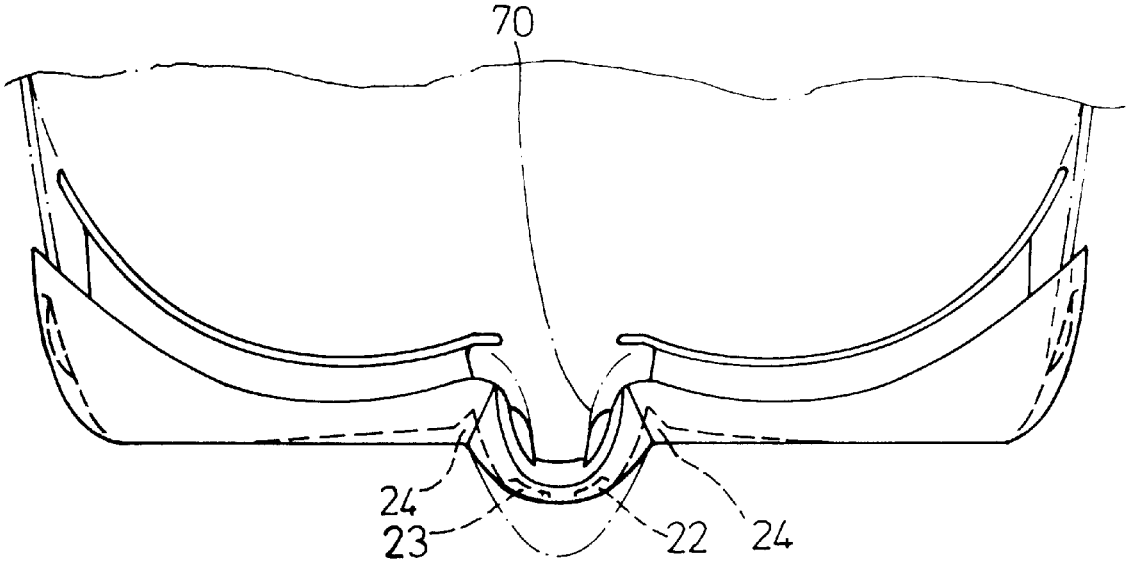
FIG. 4 is a top view of the subject invention of swimming goggles when they are worn on a user's head.
Figure 6:
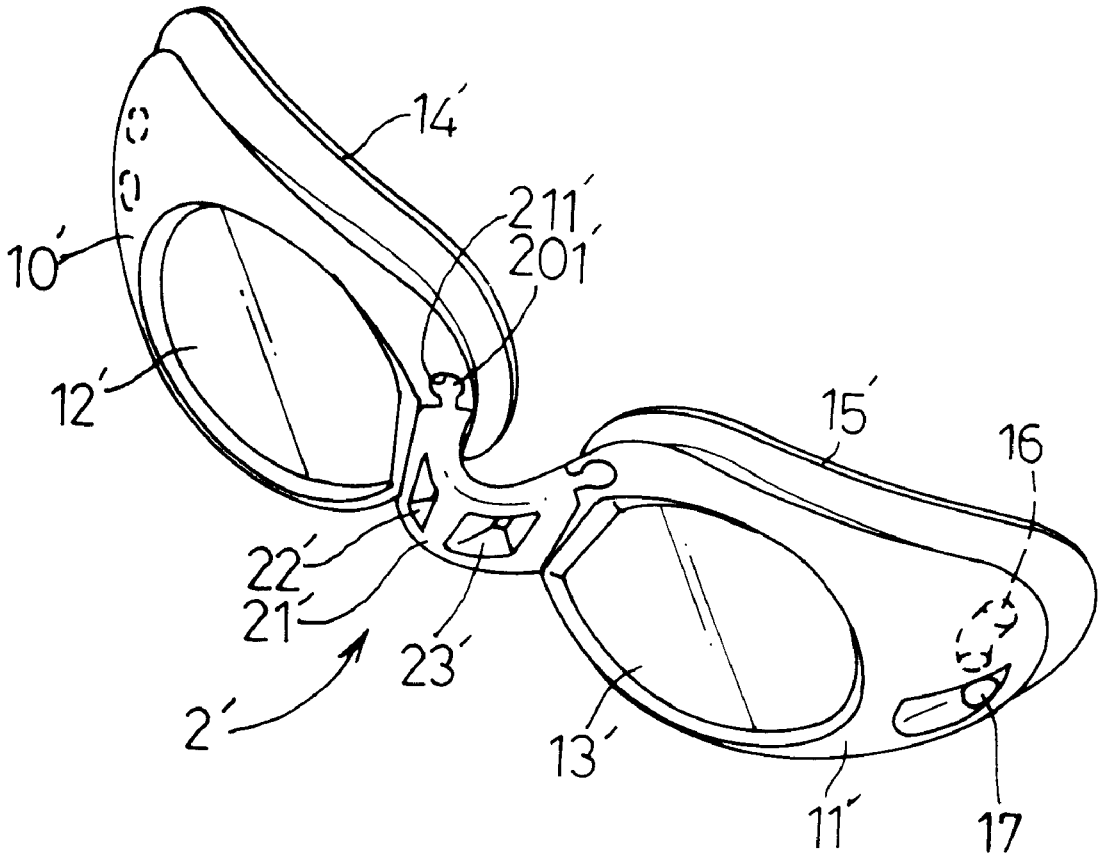
Figure 7:
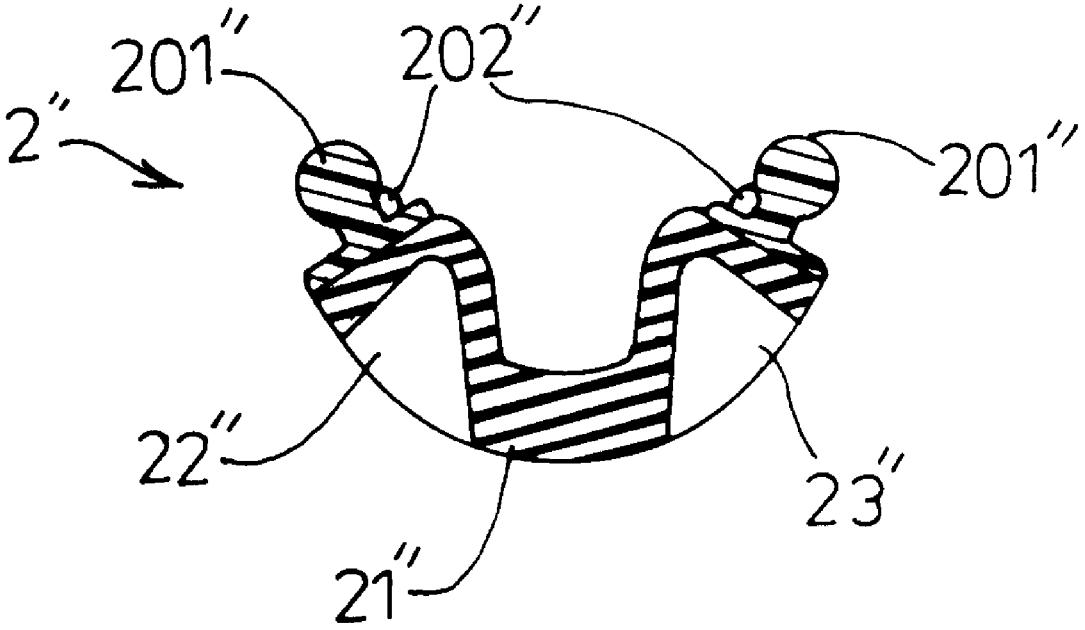
FIG. 7 is a section view of the nose bridge shown in FIG. 5.

Referring to the second embodiment of the subject invention in FIG. 5, in which, except the difference in the construction of the nose bridge 2' that is designed to be connected with the frames 10' and 11', the other parts such as the lens 12' and 13', the protective pads 14' and 15' are all the same as in the first embodiment. Please refer simultaneously to FIG. 7, on two ends of the nose bridge 2' are tenon posts 201 ' that are made of a more rigid material, one end of the tenon post 201' is a reduced neck, the other end is an arc body. On the inner edges of the frames 10' and 11' are mortise grooves 211 ' that serve to contain the neck and arc body of said tenon posts 201', said mortise groove 211' is opened on top with a slit on its side and a scaled bottom, by fastening on the reduced neck of the tenon post 201', the nose bridge 2' and the frames 10' and 11' can be secured together as one unit. Between said tenon post 201' and said mortise groove 211' are a first positioning unit and a second positioning unit, the first positioning unit being a jut 202' positioned on the tenon post 201', the second positioning unit being a catch groove 212' positioned on the mortise groove 211 ' to match said jut 202', so as to ensure better fastening effect of' the tenon post 201' with the mortise groove 21 1'. Furthermore, the tenon post 201' and 202' on said nose bridge 2' envelop a face-fitting part that is made of a softer material, said face-fitting part involves the recesses 22' and 23' on two sides of the exterior surface 21' of the nose bridge 2', the bottom ends of the two recesses 22' and 23' are protruded to contact properly with the ridge of the user's nose (as shown in FIG. 4).

By inserting the tenon posts 201' on two ends of the nose bridge 2' of the subject invention into the mortise grooves 211' on the frames 10' and 11', the two frames 10' and 11' can be joined as one unit. And, with the jut 202' on the first positioning unit and the catch groove 212' on the second positioning unit, more secure connection can be made between the nose bridge 2' and the frames 10' and 11'. Therefore, it is evident that the nose bridge in this embodiment can be conveniently and quickly joined to the frames, and since the design of the face-fitting part on the nose bridge provides better contact with the ridge of the user's nose, it enables better comfort to the user and better resistance to water seepage.

Summing up, the subject invention of swimming goggles with a nose-fitting bridge has unique construction and conspicuous performance that will satisfy the requirements of a patent. The above disclosure covering merely the preferred embodiments of the subject invention, however, shall not be based to restrict or limit the intent and scope of the subject claims, therefore, all equivalent variations or modifications made according to the subject invention shall be included in the subject claims.

What is claimed is:

1. Swimming goggles with a nose-fitting bridge, comprising two integrated frames, lenses that are accommodated in the two frames, and a nose bridge joining the two frames, as well as a headband edges of the two frames, characterized in that:

said nose bridge having at least one face-fitting part, said face-fitting part involving recesses that are formed from the nose bridge towards the frames, the bottom ends of said recesses being in proper contact with the ridge of the user's nose.

2. The swimming goggles with a nose-fitting bridge, as recited in claim 1, wherein, said face-fitting part is preferably located at the right and left sides of said nose bridge, so designed as to provide better fitting and contact with the ridge of the user's nose.

3. The swimming goggles with a nose-fitting bridge, as recited in claim 1, wherein, at the joints between the exterior surface of said nose bridge and the two frames are slotted grooves, so designed as to provide better fitting and contact.

4. The swimming goggles with a nose-fitting bridge, as recited in claim 2, wherein, at the joints between the exterior surface of said nose bridge and the two frames are slotted grooves, so designed as to provide better fitting and contact.

5. The swimming goggles with a nose-fitting bridge, as recited in claim 3, wherein, said frames have connecting holes on the sides far from the nose bridge to facilitate connection to a headband device, at least a part of said connecting holes being hidden on the exterior surface of the frames.

6. The swimming goggles with a nose-fitting bridge, as recited in claim 4, wherein, said frames have connecting holes on the sides far from the nose bridge to facilitate connection to a headband device, at least a part of said connecting holes being hidden on the exterior surface of the frames.

7. A type of swimming goggles with a nose-fitting bridge, comprising two frames, two lenses contained in the two frames, a nose bridge connecting the two frames, and a headband device fitted to the outside edges of the two frames, characterized in that: said nose bridge having al least one face-fitting part, said face-fitting part forming recesses from the exterior surface of the nose bridge towards the frames, the bottom ends of said recesses being protruded to properly fit and contact the ridge of the user's nose.

8. The swimming goggles with a nose-fitting bridge, as recited in claim 7, wherein, said face-fitting part is preferably located at the right and left sides of the nose bridge, so as to provide better contact with the ridge of the user's nose.

9. The swimming goggles with a nose-fitting bridge, as recited in claim 8, wherein, said nose bridge and frames are connected by mortise and tenon in the shapes of rigid-material tenon posts at two ends of the soft-material nose bridge and corresponding mortise grooves on the edges of the frames.

10. The swimming goggles with a nose-fitting bridge, as recited in claim 9, wherein, between said tenon post and mortise groove are a first positioning unit and a second positioning unit that are mutually engaged, so as to enable better securing effect between the post and groove, said first positioning unit being a jut on the tenon post, said second positioning unit being a corresponding catch groove in the mortise groove.

11. The swimming goggles with a nose-fitting bridge, as recited in claim 10, wherein, on the sides of the frames far away from the nose bridge are connecting holes to facilitate connection with a headband device, at least a part of said connecting hole being hidden on the exterior surface of the frames.

* * * * *